US008537097B2

(12) United States Patent
Nishikawa et al.

(10) Patent No.: US 8,537,097 B2
(45) Date of Patent: Sep. 17, 2013

(54) LIQUID CRYSTAL DISPLAY DEVICE

(75) Inventors: Norimitsu Nishikawa, Mobara (JP); Satoshi Takahashi, Isumi (JP)

(73) Assignees: Hitachi Displays, Ltd., Chiba (JP); Panasonic Liquid Crystal Display Co., Ltd., Hyogo-Ken (JP)

( * ) Notice: Subject to any disclaimer, the term of this patent is extended or adjusted under 35 U.S.C. 154(b) by 771 days.

(21) Appl. No.: 12/358,553

(22) Filed: Jan. 23, 2009

(65) Prior Publication Data

US 2009/0189846 A1 Jul. 30, 2009

(30) Foreign Application Priority Data

Jan. 24, 2008 (JP) ..... 2008-013281

(51) Int. Cl.
*G09G 3/36* (2006.01)

(52) U.S. Cl.
USPC ..... 345/102

(58) Field of Classification Search
None
See application file for complete search history.

(56) References Cited

U.S. PATENT DOCUMENTS

| | | | | |
|---|---|---|---|---|
| 2008/0111800 | A1* | 5/2008 | Wang et al. | 345/204 |
| 2008/0136769 | A1* | 6/2008 | Kim et al. | 345/102 |
| 2008/0150877 | A1* | 6/2008 | Chao et al. | 345/102 |
| 2008/0224967 | A1* | 9/2008 | Huang | 345/82 |
| 2010/0225622 | A1* | 9/2010 | Wang et al. | 345/204 |

* cited by examiner

*Primary Examiner* — Joseph Haley
*Assistant Examiner* — Emily Frank
(74) *Attorney, Agent, or Firm* — Antonelli, Terry, Stout & Kraus, LLP.

(57) ABSTRACT

The present invention provides a liquid crystal display device having an LED drive circuit which can control a dimming control signal even with a pulse width of several tens μsec or less. The LED drive circuit includes a booster circuit, a first stage current mirror circuit generating a reference current, a second stage current mirror circuit generating a driving current from the reference current, a light-emitting diode column having a light-emitting diode supplied with the driving current, and a dimming control circuit controlling the turning on and off of the light-emitting diode based on a dimming control signal.

6 Claims, 5 Drawing Sheets

LIQUID CRYSTAL DISPLAY DEVICE

CROSS-REFERENCE TO RELATED APPLICATION

The present application claims priority from Japanese application JP2008-13281 filed on Jan. 24, 2008, the content of which is hereby incorporated by reference into this application.

BACKGROUND OF THE INVENTION

1. Field of the Invention

The present invention relates to a liquid crystal display device and particularly to a drive circuit for a white light-emitting diode constituting the light source of a backlight.

2. Description of the Related Art

A liquid crystal display device generally includes a liquid crystal display panel and a backlight irradiating the liquid crystal display panel with light. A liquid crystal display device used as a display part of a mobile device such as a mobile phone includes a white light-emitting diode as the light source of a backlight.

As an LED drive circuit for the white light-emitting diode, an LED drive circuit having a dimming control function with a dimming control signal PWM has been known.

FIG. 5 is a circuit diagram showing a circuit configuration of a conventional LED drive circuit, showing an example of the LED drive circuit having the dimming control function with the dimming control signal PWM.

The LED drive circuit shown in FIG. 5 includes a booster circuit 1, a white light-emitting diode column 5 formed of one or two or more white light-emitting diodes LED connected in series with one another, and a resistance element 2 setting a current flowing in the white light-emitting diode column 5.

A voltage generated across the resistance element 2 is input to the booster circuit 1 as a control voltage VCONT. Based on the output voltage of an operational amplifier OP which outputs the difference voltage between the control voltage VCONT and a reference voltage Vref, an internal control circuit 10 boosts an input voltage Vin to generate an output voltage Vout so that the control voltage VCONT becomes a constant voltage.

The output voltage Vout of the booster circuit 1 is applied to the white light-emitting diode column 5. In this case, since the control voltage VCONT applied to the resistance element 2 is controlled so as to become constant, the current flowing to the white light-emitting diode column 5 is set based on the control voltage VCONT applied to the resistance element 2 and the resistance value of the resistance element 2.

In the LED circuit, the boosting operation of the booster circuit 1 is ON/OFF controlled with the dimming control signal PWM, whereby the turning on and off of the white light-emitting diode column 5 is controlled.

SUMMARY OF THE INVENTION

A liquid crystal display device includes a liquid crystal display panel, a backlight disposed at the back of the liquid crystal display panel, the backlight having a white light-emitting diode as a light source, and an LED drive circuit driving the white light-emitting diode. The LED drive circuit includes a booster circuit outputting a boosting voltage so that a control voltage input thereto becomes a constant voltage, a resistance circuit generating a control voltage to be input to the booster circuit, a first stage current mirror circuit having an input side transistor supplied with a current flowing through the resistance circuit and an output side transistor through which a reference current proportional to a current flowing to the input side transistor flows, a second stage current mirror circuit having an input side transistor supplied with the reference current and an output side transistor through which a driving current proportional to a current flowing to the input side transistor flows, a light-emitting diode column having at least one light-emitting diode supplied with the driving current, and a dimming control circuit bypassing the reference current supplied to the input side transistor of the second stage current mirror circuit and controlling the turning on and off of the light-emitting diode column based on a dimming control signal input to the dimming control circuit.

DESCRIPTION OF THE PREFERRED EMBODIMENTS

Figure 5:
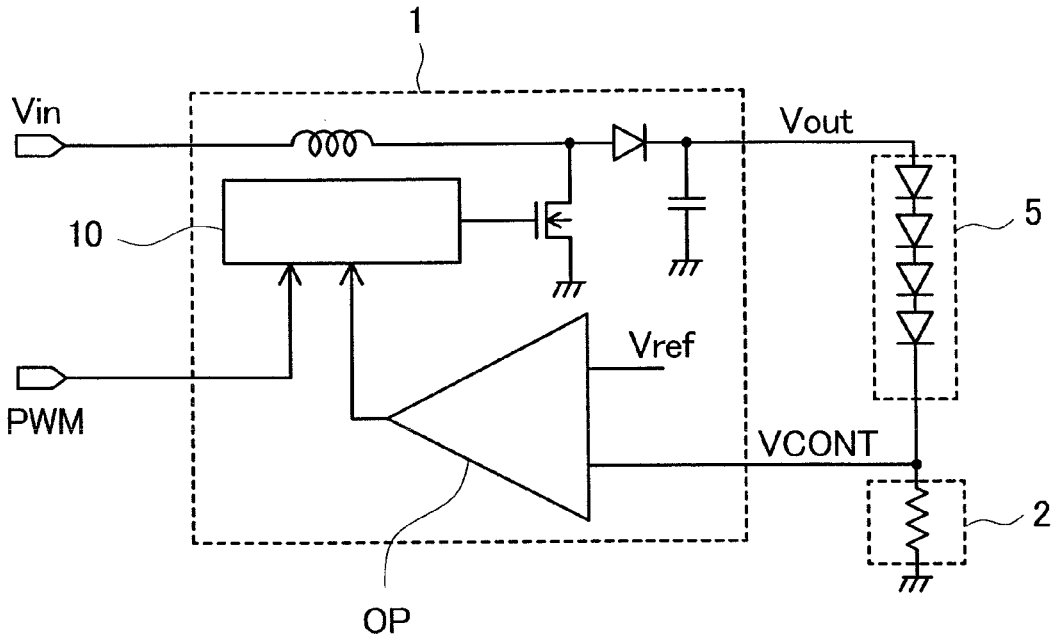
FIG. 5 PRIOR ART
FIG. 5 is a circuit diagram showing a circuit configuration of a conventional LED drive circuit.

In the circuit configuration shown in FIG. 5 described above, since the boosting operation itself of the booster circuit 1 is ON/OFF controlled, the response time is limited, resulting in a problem that the control of the dimming control signal PWM with a pulse width of several tens μsec or less cannot be realized.

The invention has been made to solve the problem in the related art, and it is an object of the invention to provide a liquid crystal display device having an LED drive circuit which can control the dimming control signal even with a pulse width of several tens μsec or less.

The above and other objects and novel features of the invention will become apparent from the description of this specification and the accompanying drawings.

A typical outline of the invention disclosed herein will be described below.

(1) A liquid crystal display device includes a liquid crystal display panel, a backlight disposed at the back of the liquid crystal display panel, the backlight having a white light-emitting diode as a light source, and an LED drive circuit driving the white light-emitting diode. The LED drive circuit includes a booster circuit outputting a boosting voltage so that a control voltage input thereto becomes a constant voltage, a resistance circuit generating a control voltage to be input to the booster circuit, a first stage current mirror circuit having an input side transistor supplied with a current flowing through the resistance circuit and an output side transistor through which a reference current proportional to a current flowing to the input side transistor flows, a second stage current mirror circuit having an input side transistor supplied with the reference current and an output side transistor through which a driving current proportional to a current flowing to the input side transistor flows, a light-emitting diode column having at least one light-emitting diode supplied with the driving current, and a dimming control circuit bypassing the reference current supplied to the input side transistor of the second stage current mirror circuit and controlling the turning on and off of the light-emitting diode column based on a dimming control signal input to the dimming control circuit.

(2) In (1), the second stage current mirror circuit has the output side transistor in plural, and the driving current flowing to each of the plural output side transistors of the second stage current mirror circuit is supplied to the light-emitting diode column.

(3) In (1), the liquid crystal display device has the light-emitting diode column in plural, the second stage current mirror circuit has the output side transistor in plural, and the driving current flowing to each of the plural output side transistors of the second stage current mirror circuit is supplied to each of the plural light-emitting diode columns.

A typical effect obtained by the invention disclosed herein will be described below.

According to the invention, it is possible to provide a liquid crystal display device having an LED drive circuit which can control the dimming control signal even with a pulse width of several tens μsec or less.

Hereinafter, embodiments of the invention will be described in detail with reference to the drawings.

Throughout the drawings for describing the embodiments, identical symbols are assigned to portions having the same functions, and they shall not be repeatedly explained.

Embodiment 1

Figure 1:
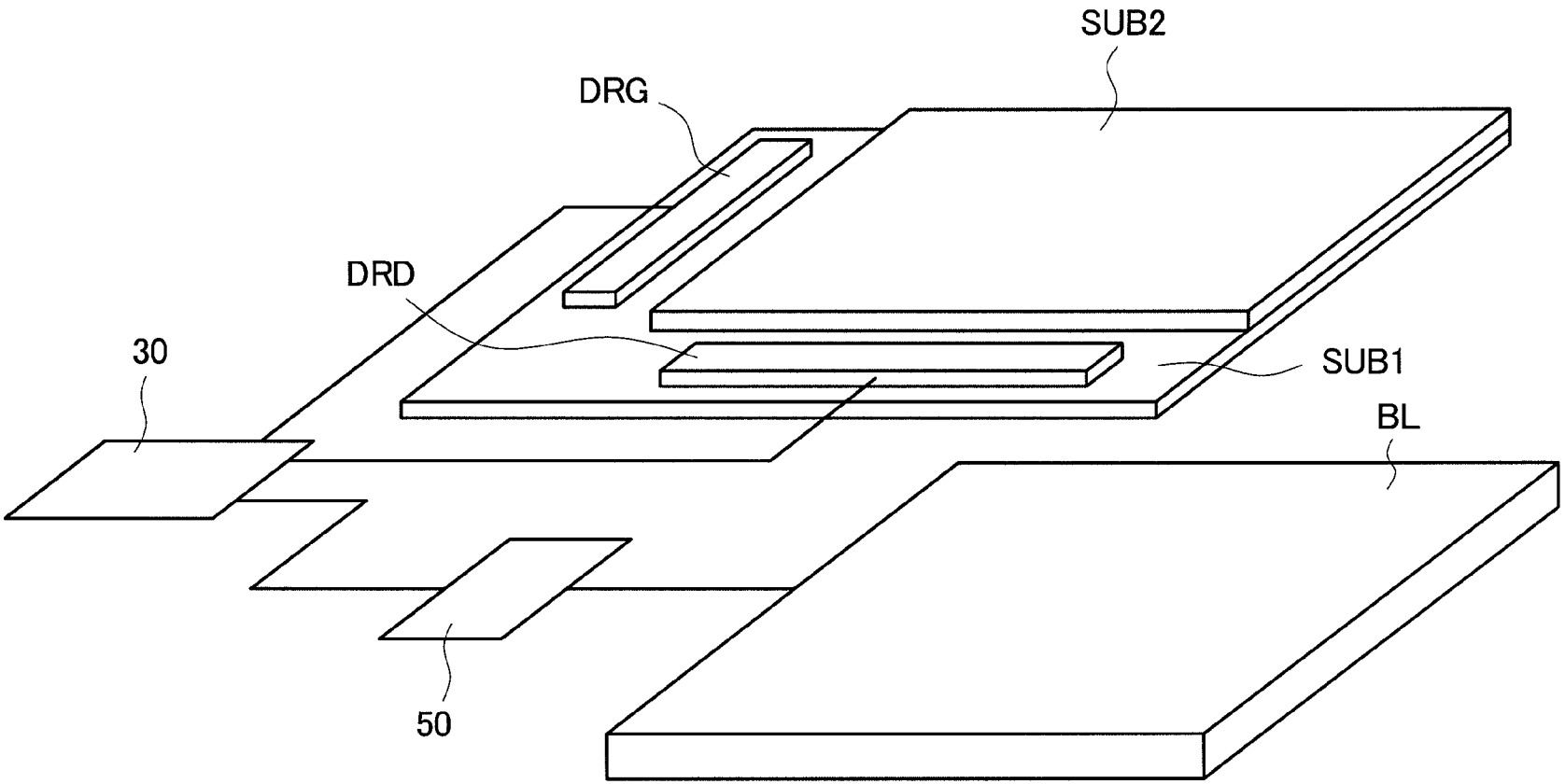
FIG. 1 is a block diagram showing a schematic configuration of a liquid crystal display device according to Embodiment 1 of the invention.

FIG. 1 is a block diagram showing a schematic configuration of a liquid crystal display device according to Embodiment 1 of the invention.

The liquid crystal display device according to Embodiment 1 includes a liquid crystal display panel and a backlight BL disposed at the back of the liquid crystal display panel.

The liquid crystal display device according to Embodiment 1 has the liquid crystal display panel and the direct type backlight BL. The liquid crystal display panel has a first substrate SUB1 and a second substrate SUB2. The first substrate SUB1 is formed with a thin film transistor, a pixel electrode, and the like, while the second substrate SUB2 is formed with a light shielding film, a color filter, and the like. A counter electrode is formed at the first substrate SUB1 when the liquid crystal display panel is of the lateral electric field type such as an IPS type, while the counter electrode is formed at the second substrate SUB2 when the liquid crystal display panel is of the vertical electric field type such as a VA type.

The liquid crystal display panel is formed by bonding the first substrate SUB1 and the second substrate SUB2 together via a sealing material and injecting and sealing liquid crystal between the first substrate SUB1 and the second substrate SUB2. A polarizer (not illustrated) is disposed at both outsides of the first substrate SUB1 and the second substrate SUB2. The invention is not directly related to the structure of the liquid crystal display panel, and therefore the structure of the liquid crystal display panel is omitted.

A video line drive circuit DRD is disposed on the first substrate SUB1 along one long side, while a scanning line drive circuit DRG is disposed on the first substrate SUB1 along one short side.

The video line drive circuit DRD and the scanning line drive circuit DRG are controlled and driven by a display control circuit (timing controller) 30.

In FIG. 1, although the video line drive circuit DRD and the scanning line drive circuit DRG have been described as each being composed of a separate semiconductor chip (two semiconductor chips), the video line drive circuit DRD and the scanning line drive circuit DRG may be composed of one semiconductor chip.

The backlight BL has a white light-emitting diode (not illustrated) as a light source, and the white light-emitting diode is driven by an LED drive circuit 50. A dimming control signal PWM is input from the display control circuit 30 to the LED drive circuit 50. The dimming control signal PWM may be input from outside to the LED drive circuit 50. The white light-emitting diode may be obtained by combining a blue light-emitting diode with a yellow phosphor.

Figure 2:
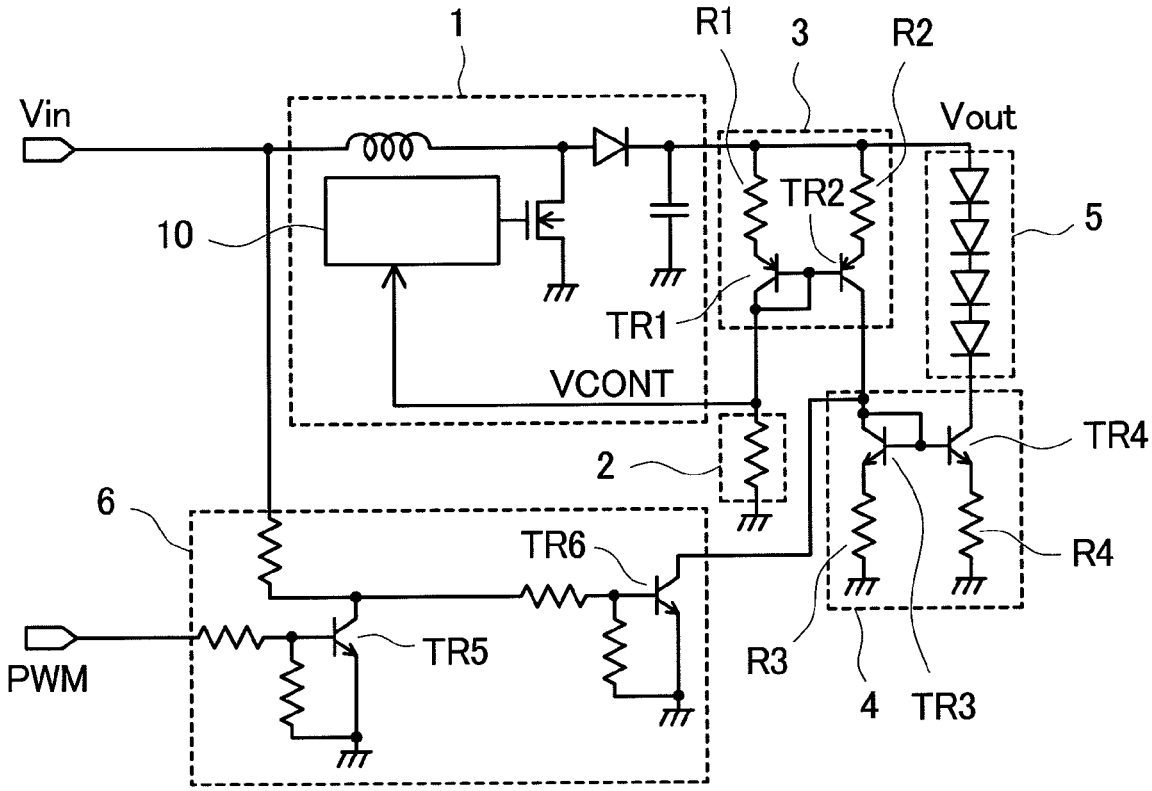
FIG. 2 is a circuit diagram showing a circuit configuration of an LED drive circuit according to Embodiment 1 of the invention.

FIG. 2 is a circuit diagram showing a circuit configuration of the LED drive circuit 50 according to Embodiment 1 of the invention.

The LED drive circuit 50 according to Embodiment 1 includes a booster circuit 1, a resistance element 2 generating a control voltage VCONT for controlling an output voltage Vout of the booster circuit 1, a white light-emitting diode column 5 formed of one or two or more white light-emitting diodes connected in series with one another, a first stage current mirror circuit 3 for generating a reference current from a current flowing to the resistance element 2, a second stage current mirror circuit 4 for generating a driving current for the white light-emitting diode column 5 from the reference current, and a dimming control circuit 6 controlling the turning on and off of the white light-emitting diode column 5 by bypassing the reference current flowing to the second stage current mirror circuit 4.

The booster circuit 1 boosts an input voltage Vin to generate the output voltage Vout with an internal control circuit 10 so that the control voltage VCONT input thereto becomes a constant voltage. The circuit can be easily formed by utilizing an IC for DC-DC converter, an LED driver IC having a boosting function, or the like.

Since a voltage generated across the resistance element 2 is applied to the booster circuit 1 as the control voltage VCONT, the operation of the booster circuit 1 is controlled so that the control voltage VCONT becomes constant.

As a result, a current flowing to the resistance element 2 is determined based on the resistance value of the resistance element 2 and the control voltage VCONT applied across the resistance element 2. The current is utilized as the reference current.

The first stage current mirror circuit 3 has two PNP bipolar transistors of an input side transistor TR1 and an output side transistor TR2 and resistance elements R1 and R2 respectively connected between the emitters of the transistors TR1 and TR2 and the output voltage Vout and has a mirror ratio which is the ratio between the resistance values of the resistance elements R1 and R2. The first stage current mirror circuit 3 extracts the reference current with the mirror ratio and flows the current to the second stage current mirror circuit 4.

The second stage current mirror circuit 4 also has two NPN bipolar transistors of an input side transistor TR3 and an output side transistor TR4 and ground resistances R3 and R4 respectively connected to the emitters of the transistors TR3 and TR4 and has a mirror ratio which is the ratio between the resistance values of the resistance elements R3 and R4. The second stage current mirror circuit 4 generates a required LED driving current with the mirror ratio and flows the current to the white light-emitting diode column 5. With this operation, the driving current flows to each of the white light-emitting diodes of the white light-emitting diode column 5, whereby each of the white light-emitting diodes of the white light-emitting diode column 5 emits light.

The white light-emitting diode column 5 connected between the second stage current mirror circuit 4 and the output voltage Vout has four white light-emitting diodes connected in series with one another in the example shown in FIG. 2. However, the number of diodes may be appropriately increased and decreased as needed but at least one.

The dimming control circuit 6 has an NPN bipolar transistor TR5 which is turned ON when the dimming control signal PWM is at a High level and turned OFF when the dimming control signal PWM is at a Low level and an NPN bipolar transistor TR6 which is turned OFF when the transistor TR5 is turned ON and turned ON when the transistor TR5 is turned OFF.

Accordingly, the dimming control circuit 6 operates nothing when the dimming control signal PWM is at a High level, and each of the white light-emitting diodes of the white light-emitting diode column 5 emits light due to the above-described operation. When the dimming control signal PWM is at a Low level, the dimming control circuit 6 bypasses a current flowing to the second stage current mirror circuit 4 and flows the current to the transistor TR6. With this operation, a current flowing to the white light-emitting diode column 5 is also stopped, whereby each of the white light-emitting diodes of the white light-emitting diode column 5 is turned off.

Although a bipolar transistor is used in the dimming control circuit 6 in the example of FIG. 2, a field-effect transistor may be used, and various switching means are applicable.

Embodiment 2

Figure 3:
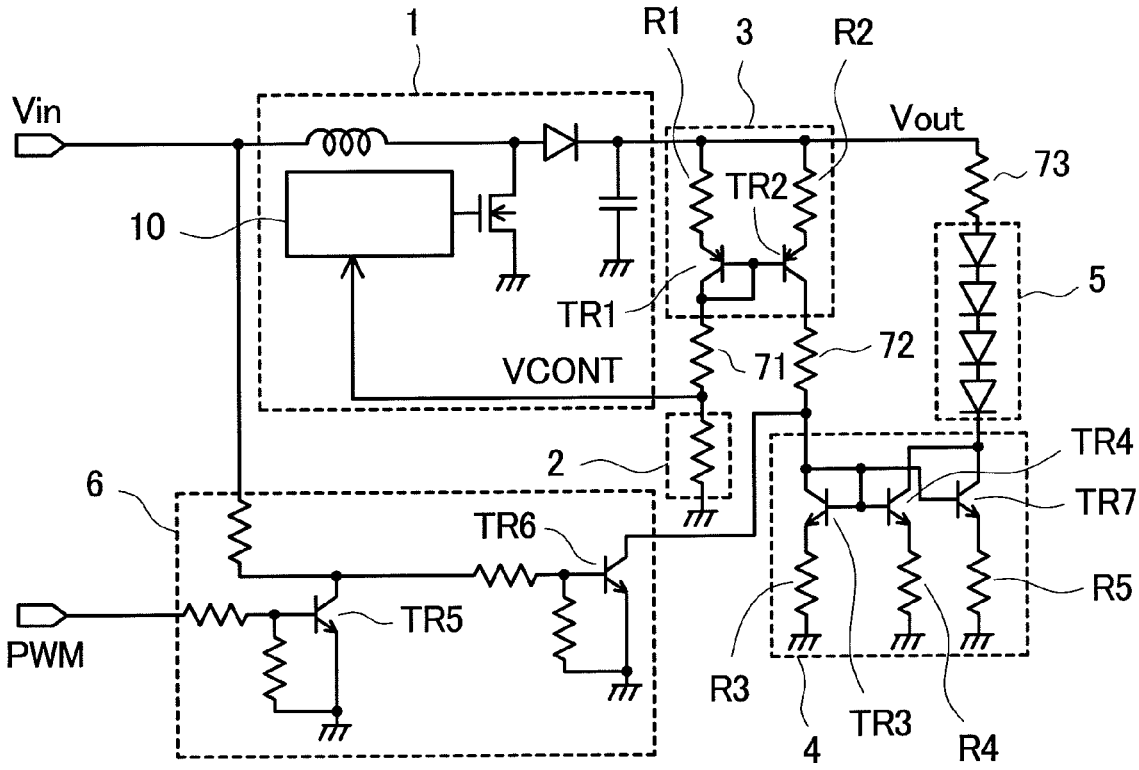
FIG. 3 is a circuit diagram showing a circuit configuration of an LED drive circuit according to Embodiment 2 of the invention.

FIG. 3 is a circuit diagram showing a circuit configuration of the LED drive circuit 50 according to Embodiment 2 of the invention.

The LED drive circuit 50 according to Embodiment 2 is obtained by making an adjustment for practical use such as securing a margin for power consumption to the LED drive circuit 50 according to Embodiment 1.

The LED drive circuit 50 according to Embodiment 2 is different from the LED drive circuit 50 shown in FIG. 2 in that resistance elements 71, 72, and 73 are added, and that the transistor and resistance element driving the white light-emitting diode column 5 are arranged as a parallel circuit with two systems of the NPN bipolar transistor TR4 and an NPN bipolar transistor TR7 and the resistance element R4 and a resistance element R5 in the second stage current mirror circuit 4.

Although the operation of the LED drive circuit 50 according to Embodiment 2 is similar to that of the LED drive circuit 50 shown in FIG. 2, the resistance elements 71 and 72 bear power consumption instead of the transistors TR1 and TR2 in the current mirror circuit 3. The resistance element 73 also bears power consumption instead of the transistors TR4 and TR7 in the second stage current mirror circuit 4.

The parallel arrangement of the transistors TR4 and TR7 and the resistance elements R4 and R5 in the current mirror circuit 4 is also for the purpose of reducing power consumption per system thereby to avoid the failure of the elements.

In the current mirror circuit 4, the parallel arrangement of transistors and resistors is not limited to two systems. The number of systems can be increased depending on the amount of power consumption.

Embodiment 3

Figure 4:
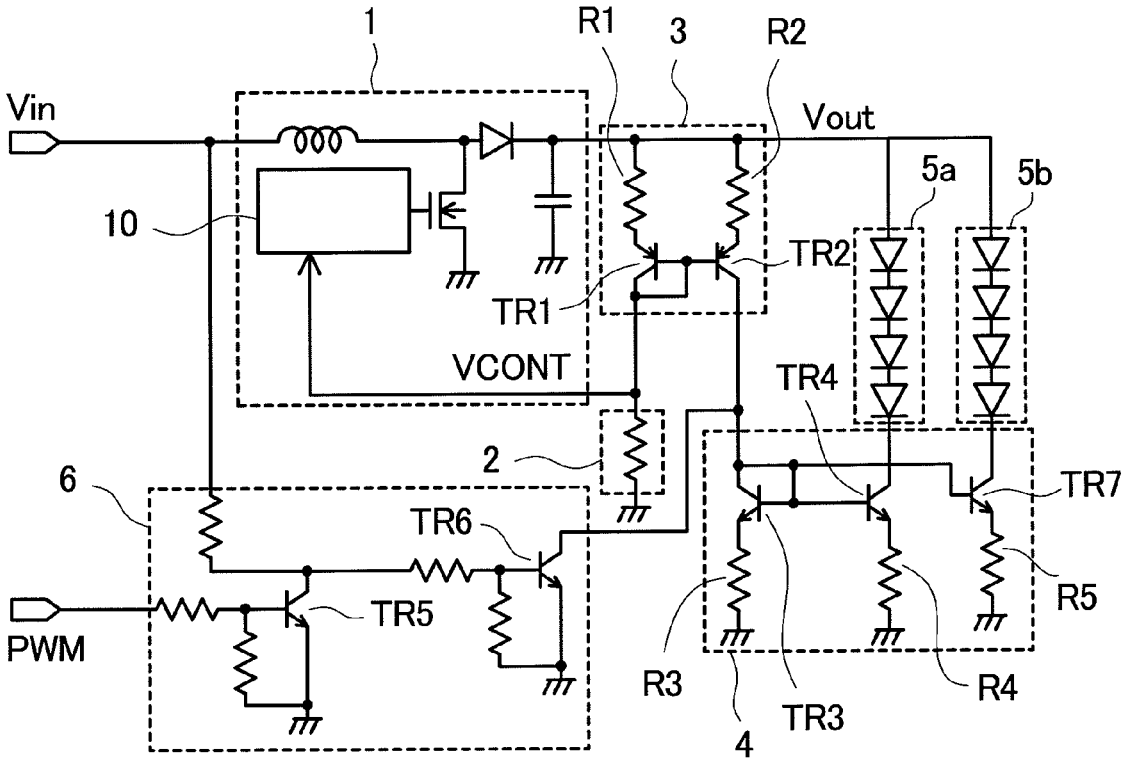
FIG. 4 is a circuit diagram showing a circuit configuration of an LED drive circuit according to Embodiment 3 of the invention.

FIG. 4 is a circuit diagram showing a circuit configuration of the LED drive circuit 50 according to Embodiment 3 of the invention.

The LED drive circuit 50 according to Embodiment 3 is different from the LED drive circuit 50 shown in FIG. 2 in that the white light-emitting diode column 5 is arranged as a parallel circuit with two systems of white light-emitting diode columns 5*a* and 5*b*, and that the transistors and resistors are arranged as a parallel circuit with two systems of the NPN bipolar transistors TR4 and TR7 and the resistance elements R4 and R5 for driving the two systems of the white light-emitting diode columns 5*a* and 5*b*.

Although the operation of the LED drive circuit 50 according to Embodiment 3 is similar to that of the LED drive circuit 50 shown in FIG. 2, in the current mirror circuit 4, the transistor TR4 and the resistance element R4 drive the white light-emitting diode column 5*a*, and the transistor TR5 and the resistance element R5 drive the white light-emitting diode column 5*b*.

In the current mirror circuit 4, the parallel arrangement of the white light-emitting diode columns, transistors, and resistor elements is not limited to two systems. The number of systems can be appropriately increased.

Further, the number of white light-emitting diodes of the white light-emitting diode columns 5*a* and 5*b* may be less than that of the white light-emitting diode column 5 in FIG. 1.

As described above, according to Embodiment 3, only the second stage current mirror circuit is ON/OFF controlled in the dimming control with the dimming control signal PWM, while the booster circuit itself remains in the operating state. Therefore, the response time depends on the transistor in the current mirror circuit, whereby it is possible to control a pulse width of about 1 μsec.

Further, since a commercially available LED driver IC, IC for booster circuit, or the like can be used for the booster circuit 1, the circuit can be formed at low cost.

Although the invention made by the present inventor has been specifically described based on Embodiments 1 to 3, the invention is not limited thereto and can be changed in various ways within a range not departing from the gist of the invention.

What is claimed is:

1. A liquid crystal display device comprising:

a liquid crystal display panel;

a backlight disposed at the back of the liquid crystal display panel, the backlight including a white light-emitting diode as a light source; and an LED drive circuit configured to drive the white light-emitting diode, wherein:

the LED drive circuit includes a booster circuit configured to output a boosting voltage so that a control voltage becomes a constant voltage, a resistance circuit configured to generate the control voltage to be input to the booster circuit, a first stage current mirror circuit including an input side transistor supplied with a current flowing through the resistance circuit and an output side transistor through which a reference current proportional to a current flowing to the input side transistor flows, a second stage current mirror circuit including an input side transistor supplied with the reference current and an output side transistor through which a driving current proportional to a current flowing to the input side transistor flows, a light-emitting diode column including the white light-emitting diode configured to be supplied with the driving current from the second stage current mirror circuit, and a dimming control circuit including a bypass transistor to bypass the reference current supplied to the input side transistor of the second stage current mirror circuit from the output side transistor of the first stage current mirror by permitting the reference current to flow through the bypass transistor based on a dimming control signal input to the dimming control circuit.

2. The liquid crystal display device according to claim 1, wherein the second stage current mirror circuit includes the output side transistor in plural, and the driving current flowing to each of the plural output side transistors of the second stage current mirror circuit is supplied to the light-emitting diode column.

3. The liquid crystal display device according to claim 1, wherein the backlight include the light-emitting diode column in plural, the second stage current mirror circuit includes the output side transistor in plural, and the driving current flowing to each of the plural output side transistors of the second stage current mirror circuit is supplied to each of the plural light-emitting diode columns.

4. A liquid crystal display device comprising:

a liquid crystal display panel;

a backlight disposed at the back of the liquid crystal display panel, the backlight including a white light-emitting diode as a light source; and an LED drive circuit configured to drive the white light-emitting diode, wherein:

the LED drive circuit includes a booster circuit configured to output a boosting voltage so that a control voltage becomes a constant voltage, a resistance circuit configured to generate the control voltage to be input to the booster circuit, a first stage current mirror circuit including an input side transistor supplied with a current flowing through the resistance circuit and an output side transistor through which a reference current proportional to a current flowing to the input side transistor flows, a second stage current mirror circuit including an input side transistor supplied with the reference current and an output side transistor through which a driving current proportional to a current flowing to the input side transistor flows, a light-emitting diode column including the white light-emitting diode configured to be supplied with the driving current from the second stage current mirror circuit, and means for bypassing the reference current supplied to the input side transistor of the second stage current mirror circuit from the output side transistor of the first stage current mirror by permitting the reference current to flow through a bypass transistor based on a dimming control signal.

5. The liquid crystal display device according to claim 4, wherein the second stage current mirror circuit includes the output side transistor in plural, and the driving current flowing to each of the plural output side transistors of the second stage current mirror circuit is supplied to the light-emitting diode column.

6. The liquid crystal display device according to claim 4, wherein the backlight includes the light-emitting diode column in plural, the second stage current mirror circuit includes the output side transistor in plural, and the driving current flowing to each of the plural output side transistors of the second stage current mirror circuit is supplied to each of the plural light-emitting diode columns.

* * * * *